US007535430B2

(12) United States Patent
Le et al.

(10) Patent No.: US 7,535,430 B2
(45) **Date of Patent: *May 19, 2009**

(54) DIRECTED DIPOLE ANTENNA HAVING IMPROVED SECTOR POWER RATIO (SPR)

(75) Inventors: Kevin Le, Arlington, TX (US); Louis J. Meyer, Shady Shores, TX (US); Pete Bisiules, LaGrange Park, IL (US)

(73) Assignee: Andrew LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/999,679

(22) Filed: Dec. 6, 2007

(65) Prior Publication Data

US 2008/0088521 A1 Apr. 17, 2008

Related U.S. Application Data

(63) Continuation of application No. 11/104,986, filed on Apr. 13, 2005, now Pat. No. 7,358,922, and a continuation-in-part of application No. 10/737,214, filed on Dec. 16, 2003, now Pat. No. 6,924,776, and a continuation-in-part of application No. 10/703,331, filed on Nov. 7, 2003, now Pat. No. 7,283,101.

(60) Provisional application No. 60/577,138, filed on Jun. 4, 2004, provisional application No. 60/484,688, filed on Jul. 3, 2003, provisional application No. 60/482,689, filed on Jun. 26, 2003.

(51) Int. Cl.
*H01Q 21/26* (2006.01)
*H01Q 21/00* (2006.01)
*H01Q 19/10* (2006.01)

(52) U.S. Cl. ..... 343/797; 343/810; 343/818

(58) Field of Classification Search ..... 343/793, 343/797, 810–820, 846
See application file for complete search history.

(56) References Cited

U.S. PATENT DOCUMENTS

| | | | | |
|---|---|---|---|---|
| 5,940,044 | A * | 8/1999 | Smith | 343/810 |
| 6,069,590 | A * | 5/2000 | Thompson et al. | 343/795 |
| 6,547,140 | B2 * | 4/2003 | Marchand | 235/462.01 |
| 6,650,301 | B1 * | 11/2003 | Zimmerman | 343/803 |
| 7,358,922 | B2 * | 4/2008 | Le et al. | 343/797 |

* cited by examiner

*Primary Examiner*—Shih-Chao Chen
(74) *Attorney, Agent, or Firm*—Robert C. Klinger

(57) ABSTRACT

A dual polarized variable beam tilt antenna having a superior Sector Power Ratio (SPR). The antenna may have slant 45 degree dipole radiating elements including directors, and may be disposed on a plurality of tilted element trays to orient an antenna boresight downtilt. The directors may be disposed above or about the respective dipole radiating elements. The antenna has a beam front-to-side ratio exceeding 20 dB, a horizontal beam front-to-back ratio exceeding 40 dB, a high-roll off, and is operable over an expanded frequency range.

25 Claims, 11 Drawing Sheets

DIRECTED DIPOLE ANTENNA HAVING IMPROVED SECTOR POWER RATIO (SPR)

CLAIM OF PRIORITY

This application is a continuation of U.S. patent application Ser. No. 11/104,986 entitled DIRECTED DIPOLE ANTENNA filed Apr. 13, 2005, now U.S. Pat. No. 7,358,922 which claims priority of U.S. Provisional Application Ser. No. 60/577,138 entitled "Antenna" filed Jun. 4, 2004, and is a Continuation-in-Part (CIP) of U.S. patent application Ser. No. 10/737,214 filed Dec. 16, 2003, now U.S. Pat. No. 6,924,776 entitled "Wideband Dual Polarized Base Station Antenna Offering Optimized Horizontal Beam Radiation Patterns And Variable Vertical Beam Tilt", which application claims priority of U.S. Provisional Patent Application Ser. No. 60/484,688 entitled "Balun Antenna With Beam Director" filed Jul. 3, 2003, and is also a Continuation-in-Part of U.S. patent application Ser. No. 10/703,331 filed Nov. 7, 2003, now U.S. Pat. No. 7,283,101 entitled "Antenna Element, Feed Probe, Dielectric Spacer, Antenna and Method of Communicating with a Plurality of Devices", which application claims priority of U.S. Provisional Patent Application Ser. No. 60/482,689 entitled "Antenna Element, Multiband Antenna, and Method of Communicating with a Plurality of Devices" filed Jun. 26, 2003.

FIELD OF THE INVENTION

The present invention is related to the field of antennas, and more particularly to antennas having dipole radiating elements utilized in wireless communication systems.

BACKGROUND OF THE INVENTION

Wireless mobile communication networks continue to be deployed and improved upon given the increased traffic demands on the networks, the expanded coverage areas for service and the new systems being deployed. Cellular type communication systems derive their name in that a plurality of antenna systems, each serving a sector or area commonly referred to as a cell, are implemented to effect coverage for a larger service area. The collective cells make up the total service area for a particular wireless communication network.

Serving each cell is an antenna array and associated switches connecting the cell into the overall communication network. Typically, the antenna array is divided into sectors, where each antenna serves a respective sector. For instance, three antennas of an antenna system may serve three sectors, each having a range of coverage of about 120°. These antennas are typically vertically polarized and have some degree of downtilt such that the radiation pattern of the antenna is directed slightly downwardly towards the mobile handsets used by the customers. This desired downtilt is often a function of terrain and other geographical features. However, the optimum value of downtilt is not always predictable prior to actual installation and testing. Thus, there is always the need for custom setting of each antenna downtilt upon installation of the actual antenna. Typically, high capacity cellular type systems can require re-optimization during a 24 hour period. In addition, customers want antennas with the highest gain for a given size and with very little intermodulation (IM). Thus, the customer can dictate which antenna is best for a given network implementation.

It is a further objective of the invention to provide a dual polarized antenna having improved directivity and providing improved sector isolation to realize an improved Sector Power Ratio (SPR).

It is an objective of the present invention to provide a dual polarized antenna array having optimized horizontal plane radiation patterns. One objective is to provide a radiation pattern having at least a 20 dB horizontal beam front-to-side ratio, at least a 40 dB horizontal beam front-to-back ratio, and improved roll-off.

It is another objective of the invention to provide an antenna array with optimized cross polarization performance with a minimum of 10 dB co-pol to cross-pol ratio in a 120 degree horizontal sector.

It is another objective of the invention to provide an antenna array with a horizontal pattern beamwidth of 50° to 75°.

It is another objective of the invention to provide an antenna array with minimized intermodulation.

It is an objective of the invention to provide a dual polarized antenna array capable of operating over an expanded frequency range.

It is a further objective of the invention to provide a dual polarized antenna array capable of producing adjustable vertical plane radiation patterns.

It is another objective of the invention to provide an antenna with enhanced port to port isolation of at least 30 dB.

It is further object of the invention to provide an inexpensive antenna.

These and other objectives of the invention are provided by an improved antenna array for transmitting and receiving electromagnetic waves with +45° and −45° linear polarizations.

DETAILED DESCRIPTION OF THE PREFERRED EMBODIMENT

Figure 1:
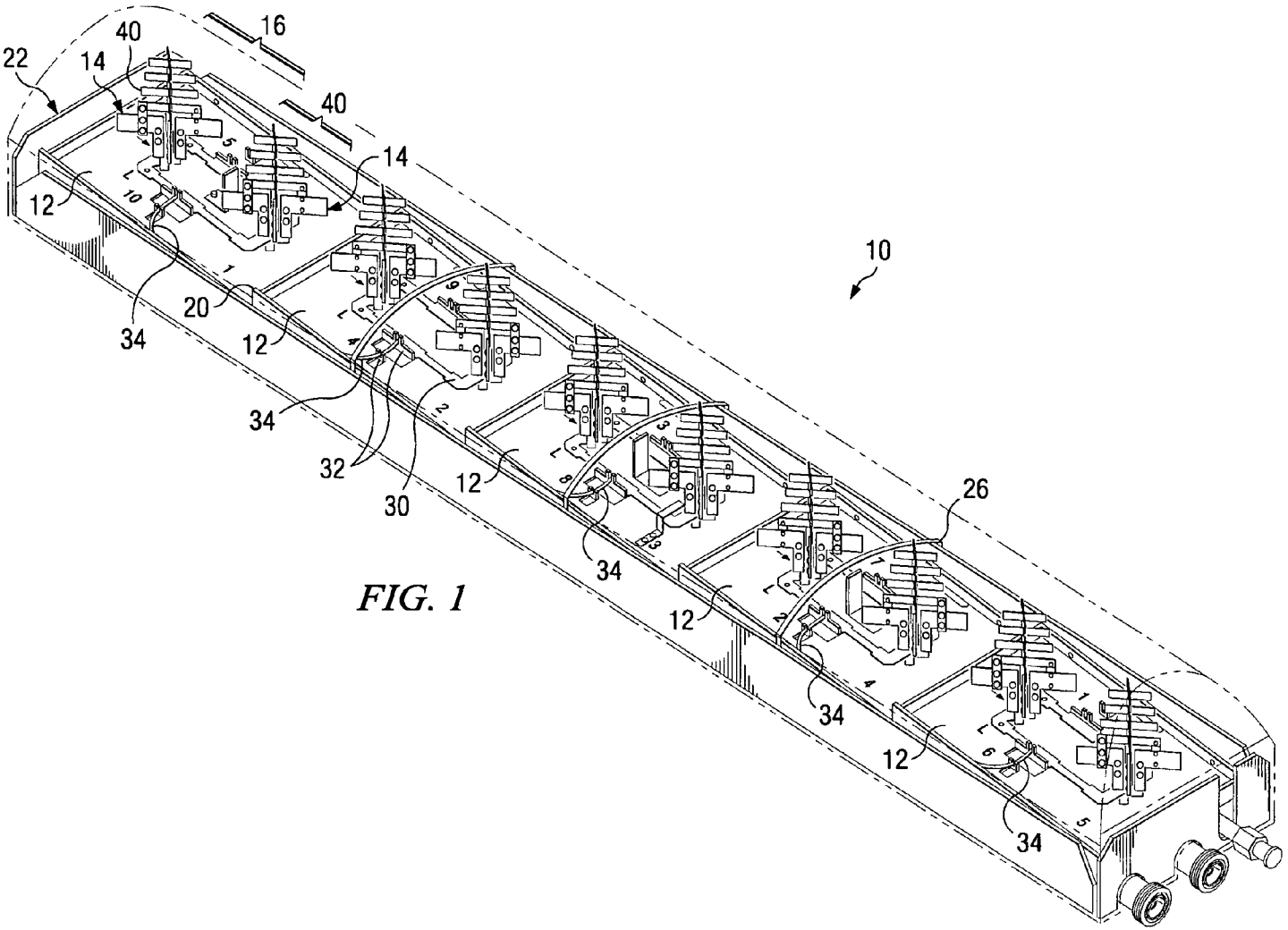
FIG. 1 is a perspective view of a dual polarized antenna according to a first preferred embodiment of the present invention.
Figure 2:
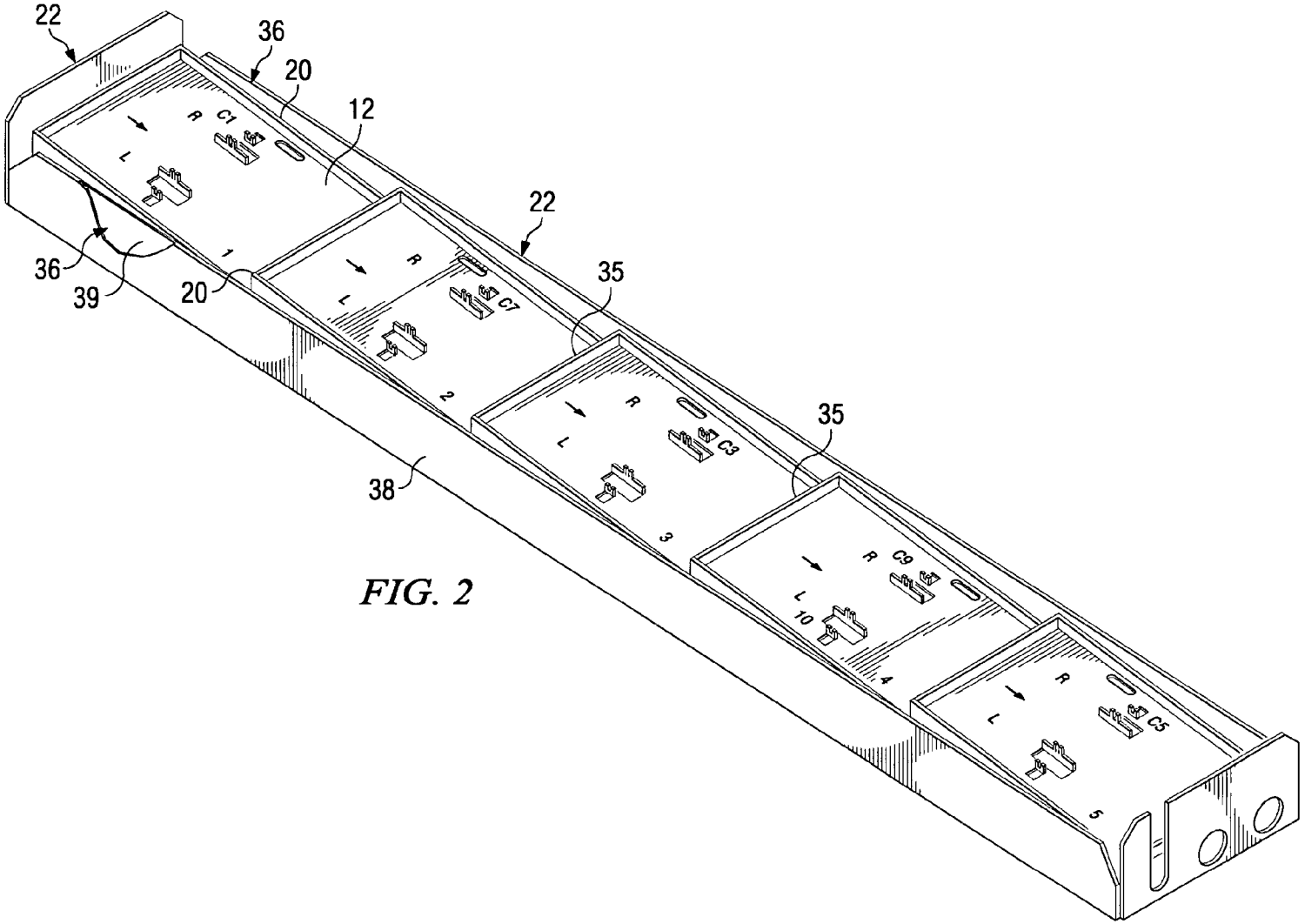
FIG. 2 is a perspective view of a multi-level groundplane structure with a broadband slant 45 cross dipole radiating element removed therefrom, and a tray cutaway to illustrate a tilting of the groundplanes and an RF absorber in a RF choke.

Referring now to FIG. 1, there is generally shown at 10 a wideband dual polarized base station antenna having an optimized horizontal radiation pattern and also having a variable vertical beam tilt. Antenna 10 is seen to include a plurality of element trays 12 having disposed thereon broadband slant 45 cross dipole (x-dipole) radiating elements 14 arranged in dipole pairs 16. Each of the element trays 12 is tilted and arranged in a "fallen domino" arrangement and supported by a pair of tray supports 20. The integrated element trays 12 and tray supports 20 are secured upon and within an external tray 22 such that there is a gap laterally defined between the tray supports 20 and the sidewalls of tray 22, as shown in FIG. 1 and FIG. 2. Each tray element 12 has an upper surface defining a groundplane for the respective dipole pair 16, and has a respective air dielectric micro stripline 30 spaced thereabove and feeding each of the dipole radiating elements 14 of dipole pairs 16, as shown. A plurality of electrically conductive arched straps 26 are secured between the sidewalls of tray 22 to provide both rigidity of the antenna 10, and also to improve isolation between dipole radiating elements 14.

As shown, a pair of cable supports 32 extend above each tray element 12. Supports 32 support a respective low IM RF connection cables 34 from a cable 76 to the air dielectric micro stripline 30 and to microstrip feed network defined on a printed circuit board 50 adhered therebelow, as will be discussed in more detail shortly with reference to FIG. 4.

Referring now to FIG. 2, there is shown a perspective view of the element trays 12 with the sidewall of one tray support 20 and tray 22 partially cut away to reveal the tilted tray elements 12 configured in the "fallen domino" arrangement. Each tray element 12 is arranged in a this "fallen domino" arrangement so as to orient the respective dipole radiating element 14 pattern boresight at a predetermined downtilt, which may, for example, be the midpoint of the array adjustable tilt range. The desired maximum beam squint level of antenna 10 in this example is consistent with about 4° downtilt off of mechanical boresight, instead of about 8° off of mechanical boresight as would be the case without the tilt of the element trays 12. According to the present invention, maximum horizontal beam squint levels have been reduced to about 5° over conventional approaches, which is very acceptable considering the antenna's wide operating bandwidth and tilt range.

Still referring to FIG. 2, there is illustrated that the tray supports 20 are separated from the respective adjacent sidewalls of tray 22 by an elongated gap defining an RF choke 36 therebetween. This choke 36 created by physical geometry advantageously reduces the RF current that flows on the backside of the external tray 22. The reduction of induced currents on the backside of the external tray 22 directly reduces radiation in the rear direction. The critical design criteria of this RF choke 36 involved in maximizing the radiation front-to-back ratio includes the height of the folded up sidewalls 38 of external tray 22, the height of the tray supports 20, and the RF choke 36 between the tray supports 20 and the sidewall lips 38 of tray 22. The RF choke 36 is preferably lambda/4 of the radiating element 14 center frequency, and the RF choke 36 has a narrow bandwidth which is frequency dependent because of internal reflection cancellation in the air dielectric, the choke bandwidth being about 22 percent of the center frequency.

According to a further embodiment of the present invention, an RF absorber 39 may be added into the RF choke 36 to make the RF choke less frequency dependent, and thus create a more broadband RF choke. The RF absorber 39 preferably contains a high percentage of carbon that slows and dissipates any RF reflection wave from effecting the main beam radiation produced by the cross dipole antenna 12. The slant 45 cross dipole antenna 14, as shown, produces a cross polarized main beam radiation at a +/−45 degree orientation, each beam having a horizontal component and a vertical component. The cross polarization is good when these components are uniform and equal in magnitude in 360 degrees. For the panel antenna 10 shown in FIG. 1 with the linearly arranged cross dipoles 14, the horizontal component of each beam orientation rolls off faster than the vertical component. This means that the vertical beamwidth is broader than the horizontal beamwidth for each beam orientation, and the vertical components travel along the edge of the respective trays 12 more than the horizontal components. Because the thin metal trays 12 have limited surface area, the surface currents thereon are less likely to reflect the horizontal components back to the main beam radiation. In contrast, along the edges of the respective trays 12 the stair cased baffles 35 have to contain many of the vertical component vector currents. Advantageously, by adding the RF absorber 39 into the RF choke 36, the vertical components of each beam orientation are minimized from reflecting back into the main beam radiation of the cross dipole 14. As such, cross dipoles 14 are not provided with a reflector behind them.

Preferably, the element trays 12 are fabricated from brass alloy and are treated with a tin plating finish for solderability. The primary function of the element trays is to support the radiating element 14 in a specific orientation, as shown. This orientation provides more optimally balanced vertical and horizontal beam patterns for both ports of the antenna 10. This orientation also provides improved isolation between each port. Additionally, the element trays 12 provide an RF grounding point at the coaxial cable/airstrip interface.

The tray supports are preferably fabricated from aluminum alloy. The primary function of the tray supports is to support the five element trays 12 in a specific orientation that minimizes horizontal pattern beam squint.

The external tray 22 is preferably fabricated from a thicker stock of aluminum alloy than element trays 12, and is preferably treated with an alodine coating to prevent corrosion due to external environment conditions. A primary functions of the external tray 22 is to support the internal array components. A secondary function is to focus the radiated RF power toward the forward sector of the antenna 10 by minimizing radiation toward the back, thereby maximizing the radiation pattern front-to-back ratio, as already discussed.

Figure 3:
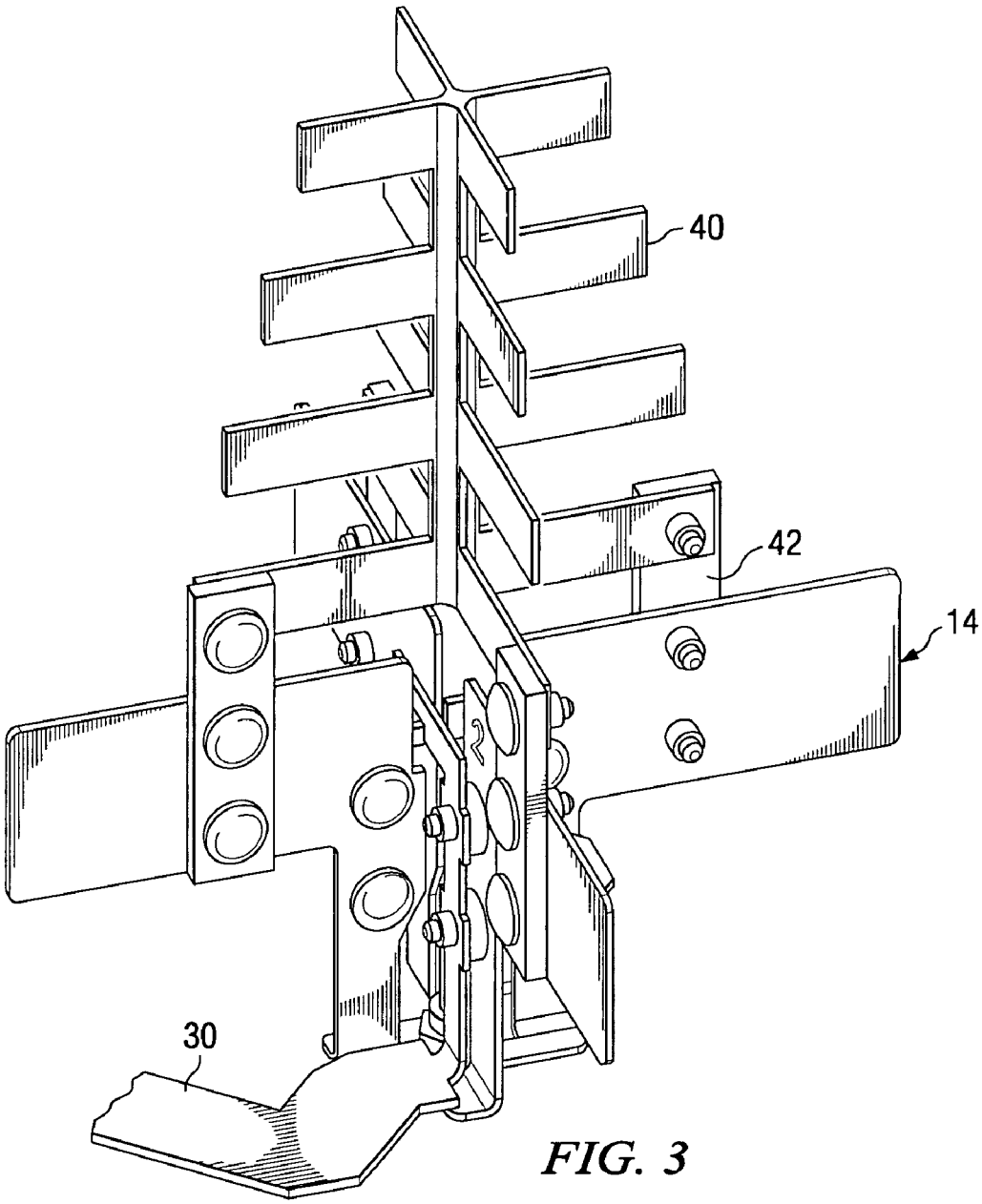
FIG. 3 is a perspective view of N cross-shaped directors supported above the dipole radiating element.

Referring now to FIG. 3 there is depicted one radiator element 14 having N laterally extending parasitic broadband cross dipole directors 40 disposed above the radiating element 14 and fed by the airstrip feed network 30, as shown. N is 1, 2, 3, 4 . . . , where N is shown to equal 4 in this embodiment. The upper laterally extending members of parasitic broadband cross dipole director 40 are preferably uniformly spaced from one another, with the upper members preferably having a shorter length, as shown for bandwidth broadening. The lower members of director 40 are more closely spaced from the radiating element 14, so as to properly couple the RF energy to the director in a manner that provides pattern enhancement while maintaining an efficient impedance match such that substantially no gain is realized by the director 40, unlike a Yagi-Uda antenna having a reflector and spaced elements each creating gain. Advantageously, rather than realized gain, an improved pattern rolloff is achieved beyond the 3 dB beamwidth of the radiation pattern while maintaining a similar 3 dB beamwidth. Preferably, the upper elements of directors 40 are spaced about 0.033 lambda (center frequency) from one another, with the lower director elements spaced from the radiating element 14 about 0.025 lambda by parasitic 42 (lambda being the wavelength of the center frequency of the radiating element 14 design).

Figure 4:
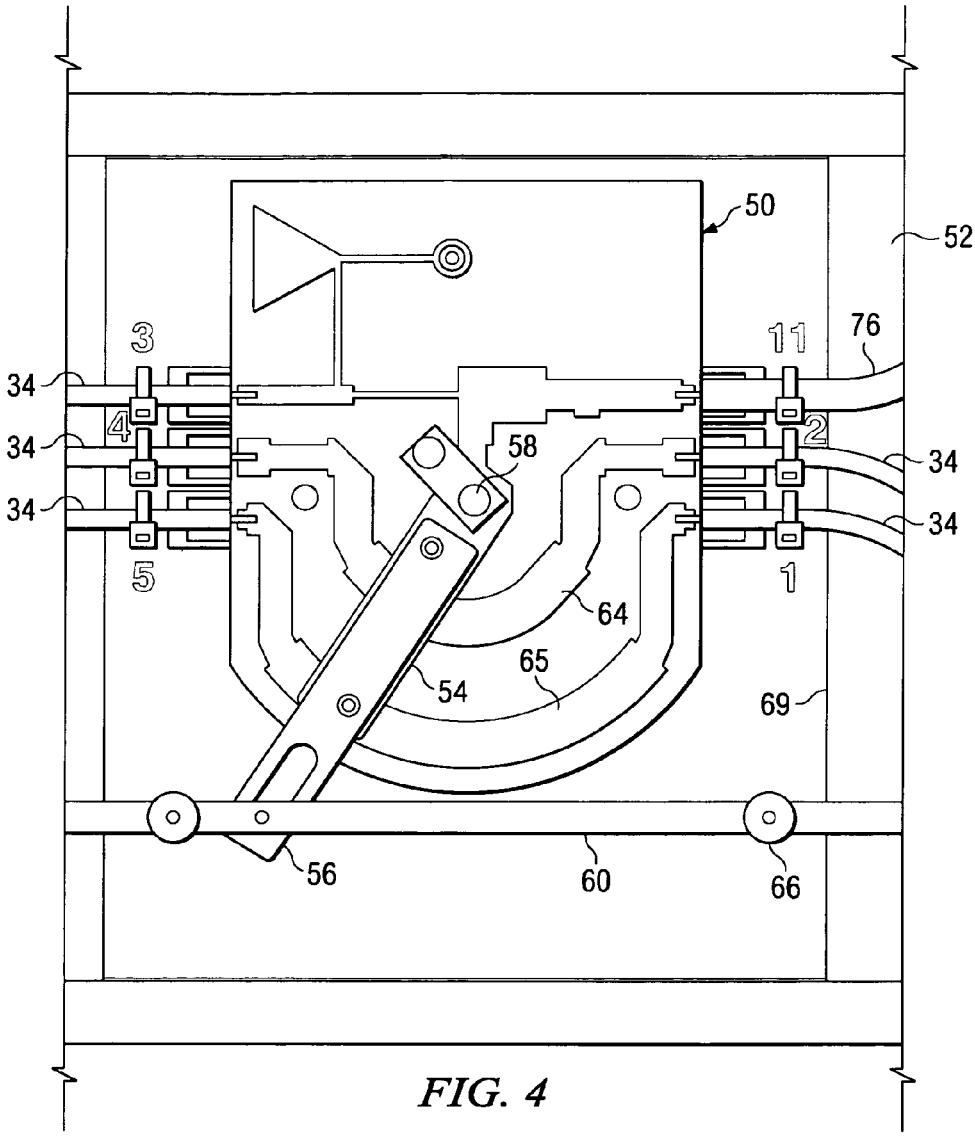
FIG. 4 is a backside view of one element tray illustrating a microstrip phase shifter design employed to feed each pair of the cross dipole radiating elements.

Referring now to FIG. 4 there is shown one low loss printed circuit board (PCB) 50 having disposed thereon a microstrip capacitive phase shifter system generally shown at 52. The low loss PCB 50 is secured to the backside of the respective element tray 12. Microstrip capacitive phase shifter system 52 is coupled to and feeds the opposing respective pair of radiating elements 14 via the respective cables 34.

As shown in FIG. 4, each microstrip phase shifter system 52 comprises a phase shifter wiper arm 56 having secured thereunder a dielectric member 54 which is arcuately adjustable about a pivot point 58 by a respective shifter rod 60. Shifter rod 60 is longitudinally adjustable by a remote handle (not shown) so as to selectively position the phase shifter wiper arm 56 and the respective dielectric 54 across a pair of arcuate feedline portions 62 and 64 to adjust the phase velocity conducting therethrough. Shifter rod 60 is secured to, but spaced above, PCB 50 by a pair of non-conductive standoffs 66. The low loss coaxial cables 34 are employed as the main transmission media providing electrical connection between the phase shifter system 52 and the radiating elements 14. Gain performance is optimized by closely controlling the phase and amplitude distribution across the radiating elements 14 of antenna 10. The very stable phase shifter design shown in FIG. 4 achieves this control.

Figure 5:
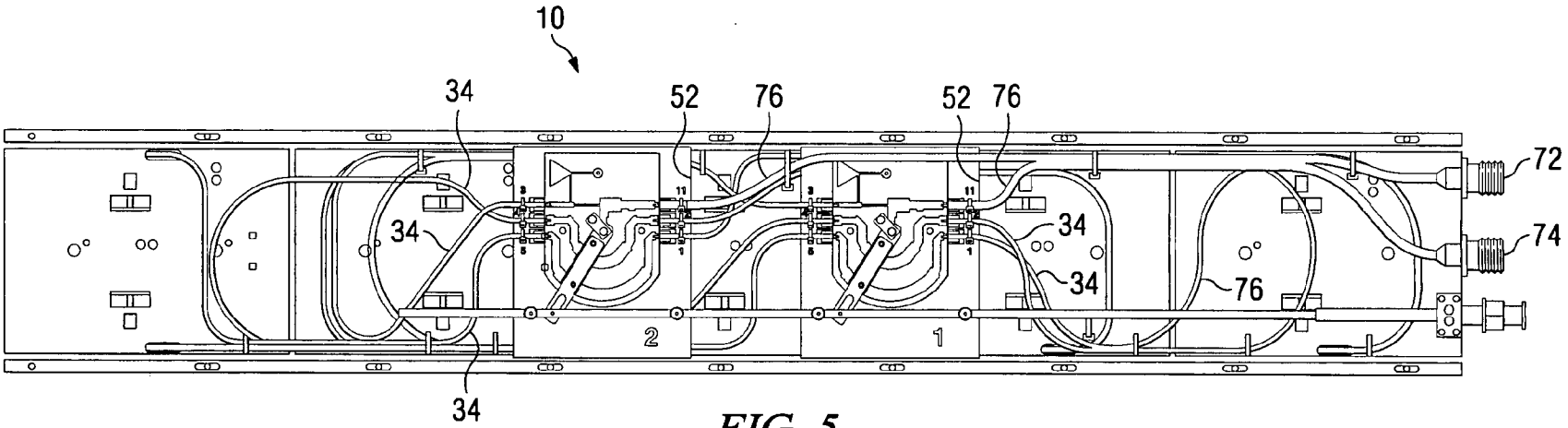
FIG. 5 is a backside view of the dual polarized antenna illustrating the cable feed network, each microstrip phase shifter feeding one of the other dual polarized antennas.

Referring now to FIG. 5, there is shown the backside of the antenna 10 illustrating the cable feed network, each microstrip phase shifter system 52 feeding one of the other polarized antennas 14. Input 72 is referred as port I and is the input for the −45 polarized Slant, and input 74 is the port II input for the +45 polarized Slant. Cables 76 are the feed lines coupled to one respective phase shifter system 52, as shown in FIG. 4. The outputs of phase shifter system 52, depicted as outputs 1-5, indicate the dipole pair 16 that is fed by the respective output of the phase shifter 52 system.

Figure 6:
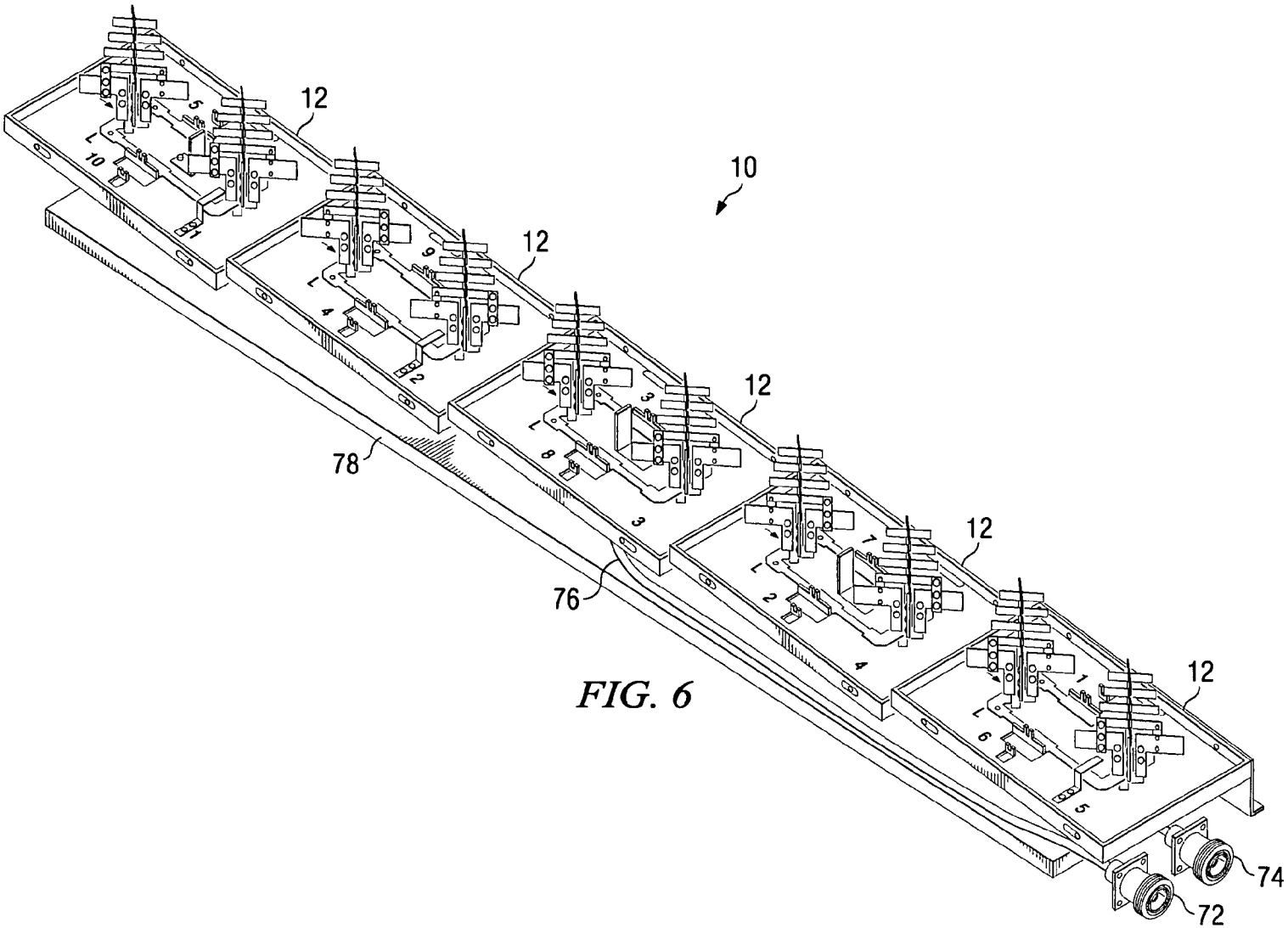
FIG. 6 is a perspective view of the dual polarized antenna including an RF absorber functioning to dissipate RF radiation from the phase shifter microstriplines, and preventing the RF current cross coupling.

Referring now to FIG. 6, there is shown antenna 10 further including an RF absorber 78 positioned under each of the element trays 12, behind antenna 10, that functions to dissipate any rearward RF radiation from the phase shifter microstrip lines, and preventing RF current from coupling between phase shifters systems 52.

Figure 7:
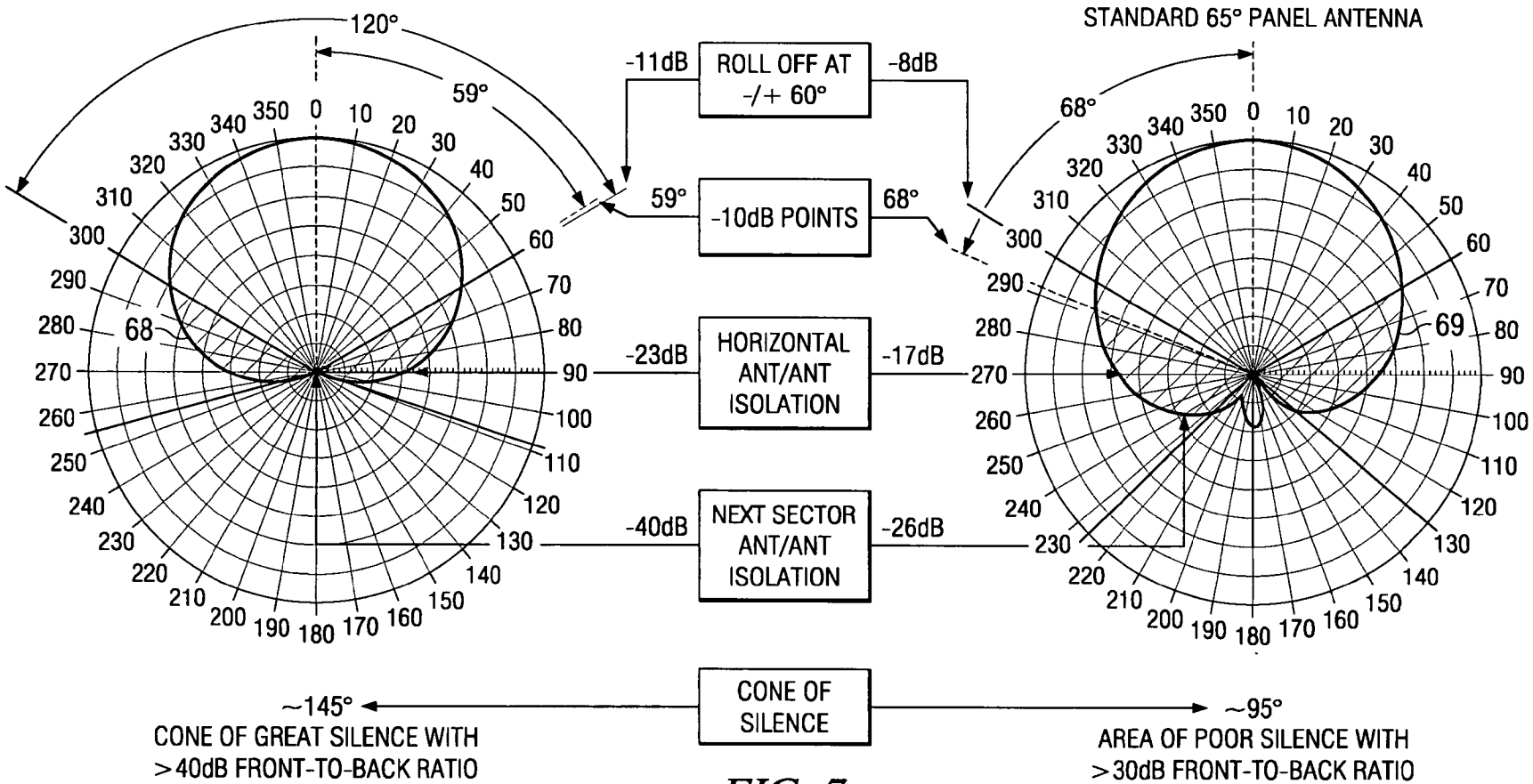
FIG. 7 is a graph depicting the high roll-off radiation pattern achieved by the present invention, as compared to a typical cross dipole antenna radiation pattern.

Referring now to FIG. 7, there is generally shown at 68 the high roll-off and front-to-back ratio radiation pattern achieved by antenna 10 according to the present invention, as compared to a standard 65° panel antenna having a dipole radiation pattern shown at 69. This high roll-off radiation pattern 68 is a significant improvement over the typical dipole radiation pattern 69. The horizontal beam width still holds at approximately 65 degree at the 3 dB point.

Further, the design of the radiating elements 14 with directors 40 provides dramatic improvements in the antenna's horizontal beam radiation pattern, "where the Front-to-Side levels are shown to be 23 dB in FIG. 7. Conventional, cross dipole radiating elements produce a horizontal beam radiation pattern with about a 17 dB front-to-side ratio, as shown in FIG. 7. According to the present invention, the broadband parasitic directors 40 integrated above the radiating elements 14 advantageously improve the antenna front-to-side ratio by up to 10 dB, and is shown as 6 dB delta in the example of FIG. 7. This improved front-to-side ratio effect is referred to as a "high roll-off" design. In this embodiment, radiating elements 14 and cross dipole directors 40 advantageously maintain an approximately 65 degree horizontal beamwidth at the antenna's 3 dB point, unlike any conventional Yagi-Uda antenna having more directors to get more gain and thus reducing the horizontal beamwidth.

Still referring to FIG. 7, there is shown the excellent front-to-back ratio of antenna 10. As shown, panel antenna 10 has a substantially reduced backside lobe, thus achieving a front-to-back ratio of about 40 dB. Moreover, antenna 10 has a next sector antenna/antenna isolation of about 40 dB, as compared to 26 dB for the standard 65° panel antenna. As can also be appreciated in FIG. 7, with the significant reduction of a rear lobe, a 120° sector interference free zone is provided behind the radiation lobe, referred to in the present invention as the "cone of silence".

Figure 8A:
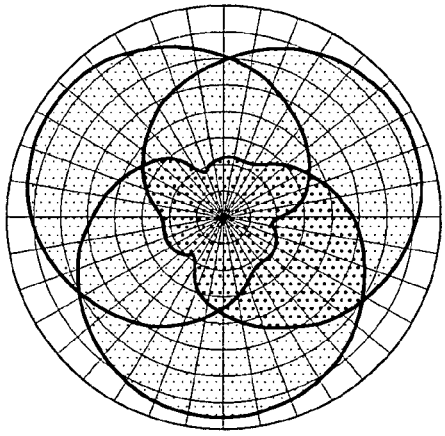
FIGS. 8A and 8B are graphs depicting the beam patterns in a three sector site utilizing standard panel antennas.
Figure 8B:
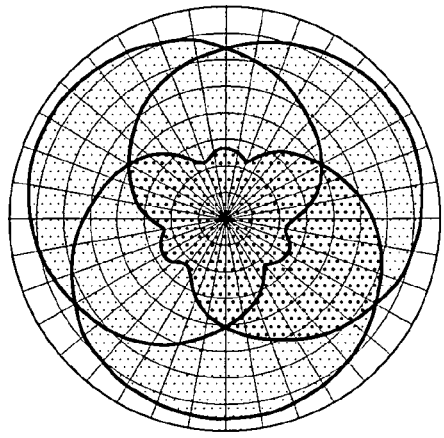

Referring now to FIGS. 8A and 8B, there is shown several advantages of the present invention when employed in a three sector site. FIG. 8A depicts standard 65° flat panel antennas used in a three sector site, and FIG. 8B depicts standard 90° panel antennas used in a three sector site. The significant overlap of these antenna radiation patterns creates imperfect sectorization that presents opportunities for increased softer hand-offs, interfering signals, dropped calls, and reduced capacity.

Figure 9A:
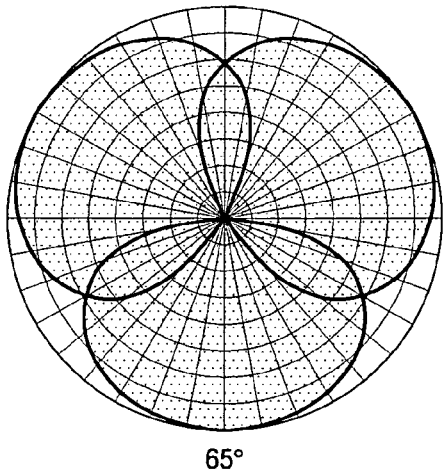
FIGS. 9A and 9B are graphs depicting the beam patterns in a three sector site utilizing antennas according to the present invention.
Figure 9B:
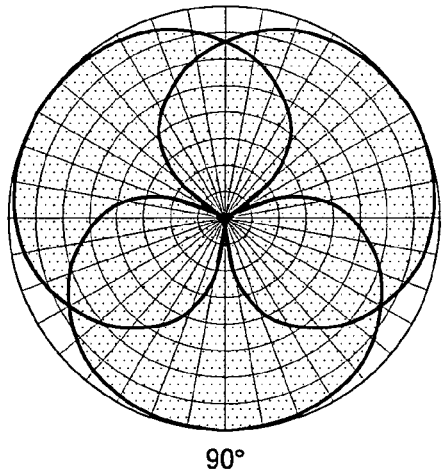

Referring now to FIGS. 9A and 9B, there is shown technical advantages of the present invention utilizing a 65° panel antenna and a 90° panel antenna, respectively according to the present invention, employed in a three sector site. With respect to FIG. 9A, there is depicted significantly reduced overlap of the antenna radiation lobes, thus realizing a much smaller hand-off area. This leads to dramatic call quality improvement, and further, a 5-10% site capacity enhancement.

Referring back to FIG. 7, the undesired lobe extending beyond the 120° sector of radiation creates overlap with adjacent antenna radiation patterns, as shown in FIG. 8A-8B and FIG. 9A-9B. The undesired power delivered in the lobe outside of the 120° forward sector edges, as compared to that desired power delivered inside this 120° sector, defines what is referred to as the Sector Power Ratio (SPR). Advantageously, the present invention achieves a SPR being less than 2%, where the SPR is defined by the following equation:

$$SPR(\%) = \frac{\sum_{60}^{300} P \text{ Undesired}}{\sum_{300}^{60} P \text{ Desired}} \times 100$$

This SPR is a significant improvement over standard panel antennas, and is one measure of depicting the technical advantages of the present invention. The directors 40 are impedance matched at 90 ohms, although limitation to this impedance is not inferred, to the micro stripline 30. The radiating elements 14 and the cross dipole directors 40 have mutual instantaneous electromagnetic coupling which generate with source impedance at 90 ohm and source voltage of a matching network. Many other system level performance benefits are afforded by incorporation of this high roll-off antenna design, including improved soft handoff capabilities, reduced co-site channel interference and increased base station system capacity due to increased sector-to-sector rejection.

Figure 10:
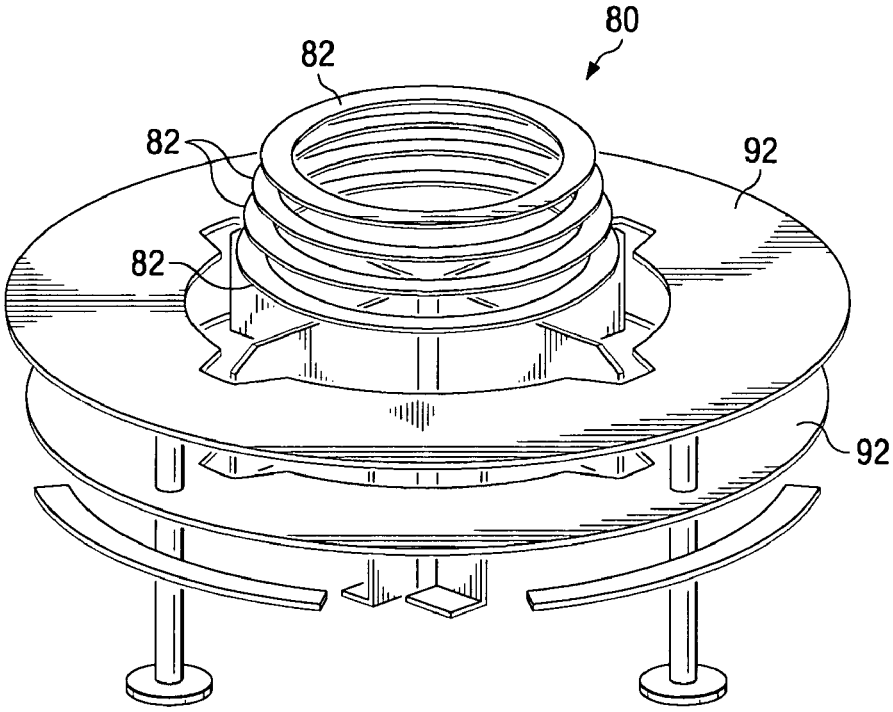
FIG. 10 is a perspective view of another embodiment of the invention including dual-band radiating elements.
Figure 13:
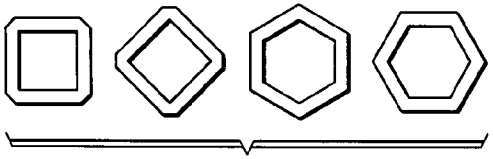
FIG. 13 is a view of various suitable configurations of directors.

Referring now to FIG. 10, there is shown another preferred embodiment of the invention seen to comprise a band, dualpol antenna 80 including one slant 45 crossed dipole radiating element 14 and a slant 45 microstrip Annular Ring (MAR) radiator 94 encircling said dipole, as will be described shortly in reference to FIG. 11. In this embodiment, antenna 80 includes N annular (ring-like) directors 82 disposed above the radiating element 14, where N=1, 2, 3, 4 . . . . The N directors 82 are configured as vertically spaced parallel polygon-shaped members, shown as concentric rings, although limitation to this geometry of directors 82 is not to be inferred. Other geometric configurations of the directors may be utilized as shown in FIG. 13.

The ring directors 82 react with the corresponding dipole radiating element 14 to enhance the front-to-side ratio of antenna 10 with improved rolloff. The ring directors 82 are preferably uniformly spaced above the corresponding x-dipole radiating element 14, with the ascending ring directors 82 having a continually smaller circumference. The ring directors 82 maintain a relatively close spacing with one another being separated by electrically non-conductive spacers, not shown, preferably being spaced less than 0.15 lambda (lambda being the wavelength of the center frequency of the antenna design). Additionally, the grouping of ring directors 82 maintain a relatively close spacing between the bottom-most director 82 and the top of the corresponding dipole radiating element 14, preferably less than 0.15 lambda. There are a variety of methods to build the set of planar directors 82, such as molded forms and electrically insulating clips.

The set of stacked ring directors 82 may also consist of rings of equal circumference while maintaining similar performance of improved roll-off leading to an improved SPR with the previously stated system benefits while maintaining a similar 3 dB beamwidth.

Figure 11:
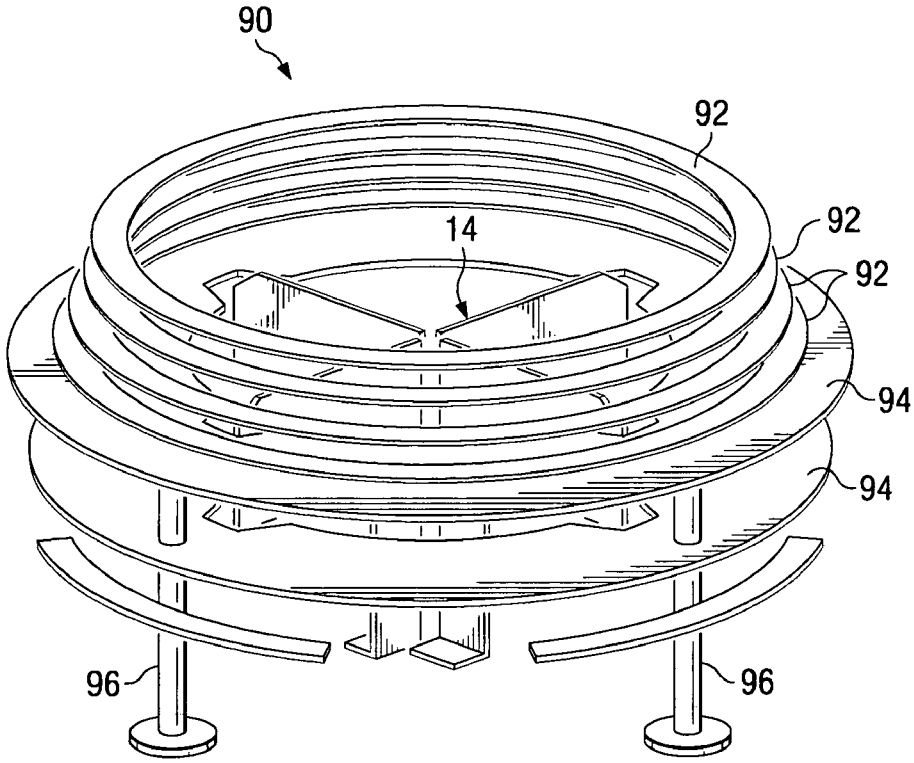
FIG. 11 is a perspective view of the embodiment shown in FIG. 10 having director rings disposed over one of the radiating elements.

Referring now to FIG. 11, there is shown at 90 a dual-band antenna including a set of director rings 92 disposed above a stacked Microstrip Annular Ring (MAR) radiator 94. In this view, there are four feedprobes 96 (2 balanced feed pairs) arranged in pairs feeding dual orthogonal polarizations of the MAR radiator 94. The directors 92 in this embodiment of the invention are thin rings stacked above the respective MAR radiator 94, as shown. Advantageously, this dual-band antenna 90 also has improved element pattern roll-off beyond the 3 dB beamwidth thus increasing the SPR while maintaining an equivalent 3 dB beamwidth.

Figure 12:
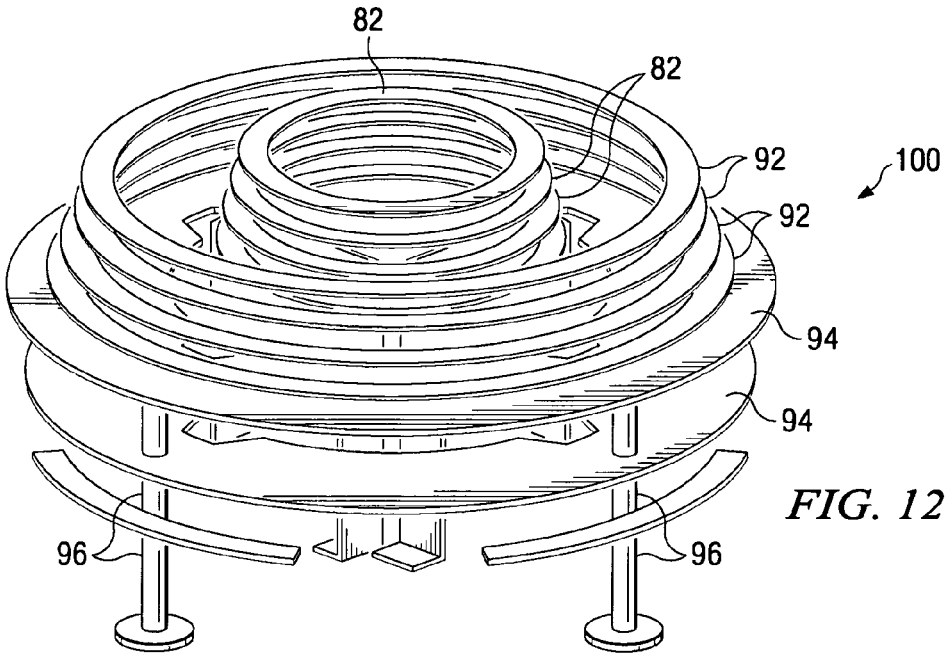
FIG. 12 is a perspective view of an embodiment of the invention having director rings disposed over each of the radiating elements.

Referring now to FIG. 12, there is shown a dual-band antenna 100 having ring directors 82 and 92. The ring directors 92 above the MAR radiator 94 also interact with the x-dipole radiating element 14 and provide some additional beamshaping for the x-dipole radiating element, including improved roll-off of the main beam outside of the 3 dB beamwidth as well as improved front-to-back radiation leading to an improved SPR and the system benefits previously mentioned while maintaining a similar 3 dB beamwidth.

Both the MAR radiator element 94 and the x-dipole radiating element 14 have respective ring directors thereabove. The ring directors 82 for the x-dipole radiating element 14 are also concentric to the ring directors 92 for the MAR radiator 94. The same benefits as discussed earlier for the directors are applicable here as well per frequency band (i.e. improved roll-off beyond the 3 dB beamwidth and front-to-back ratio leading to improved SPR.

Referring now to FIG. 13, there is shown other suitable geometrical configurations of directors 82 and 92, and limitation to a circular ring-like director is not to be inferred. A circle is considered to be an infinitely sided polygon where the term polygon is used in the appending claims.

Figure 14:
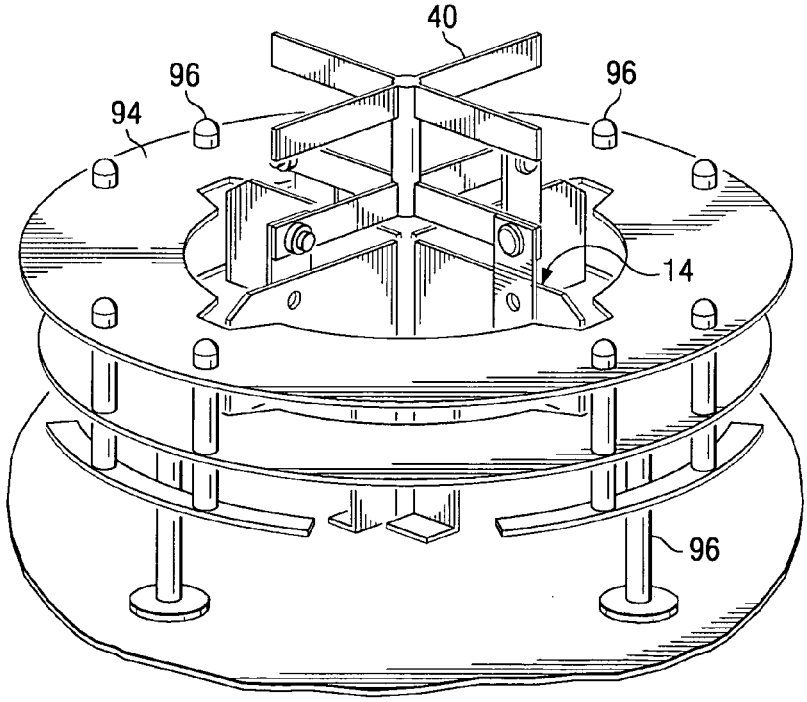
FIG. 14 is a close-up view of a dual-band antenna.

Referring now to FIG. 14, there is shown a close-up view of dual band antenna 80 having cross shaped directors 40 extending over the radiating element 14, and the MAR radiator 94 without the associated annular director.

Figure 15:
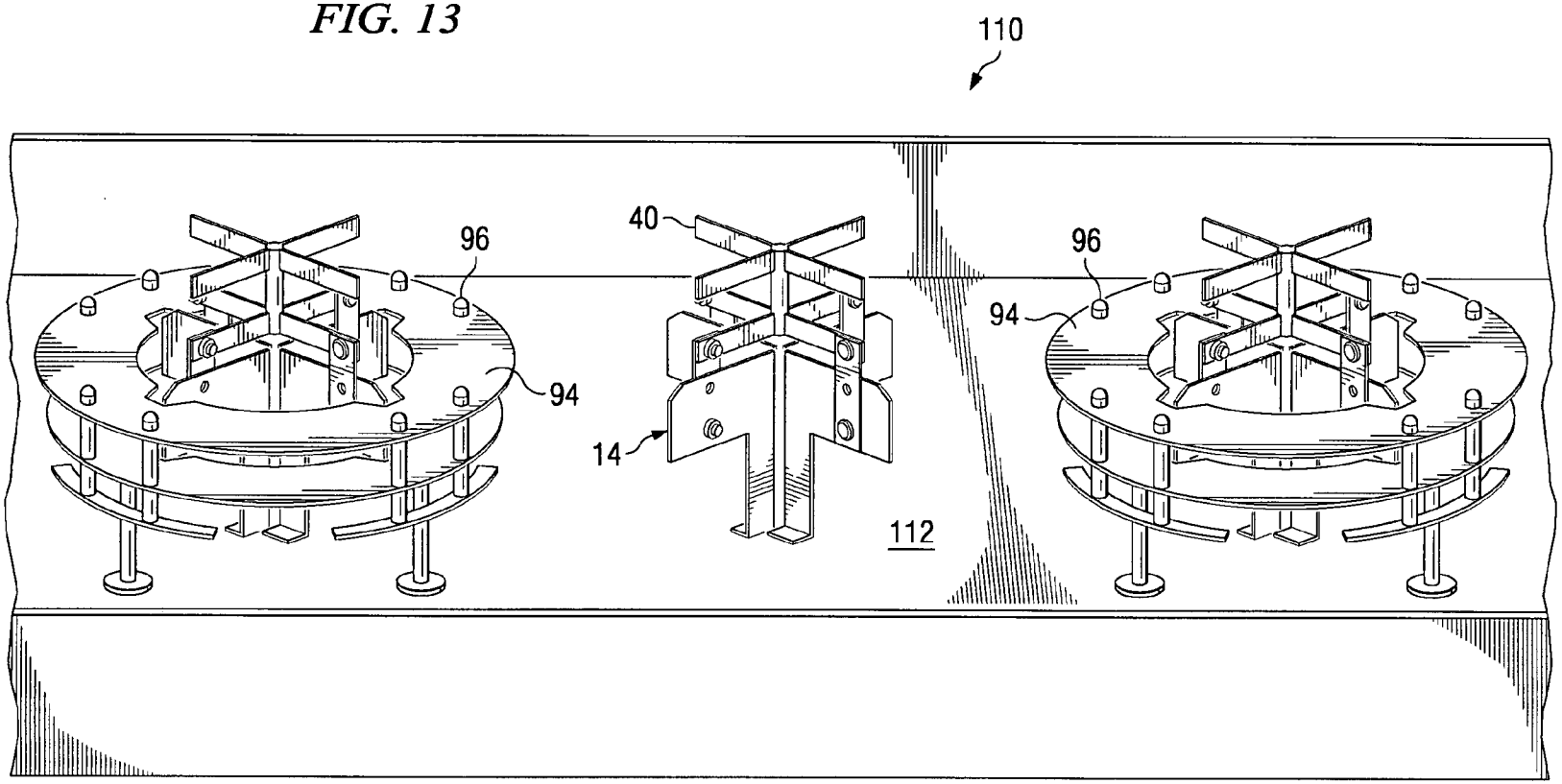
FIG. 15 depicts an array of dual-band and single-band dipole radiating elements.

Referring now to FIG. 15, there is shown a panel antenna 110 having an array of radiating elements 14, each having cross directors 40, alternately provided with the MAR radiators 94, each disposed over common groundplane 112. The advantages of this design include an improved H-plane pattern for the higher frequency radiating element in a dualband topology. The improved H-plane pattern provides improved roll-off beyond the 3 dB beamwidth and improved front-to-back ratio. The improved roll-off additionally provides a slight decoupling of the radiators depending on the number of directors incorporated due to lower levels of side and back radiation.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

We claim:

1. An antenna, comprising:

at least one slant 45 degree dipole radiating element adapted to generate a beam; and at least one director disposed proximate the at least one slant 45 degree dipole radiating element adapted to improve a Sector Power Ratio (SPR) of the beam while maintaining an equivalent 3 dB beamwidth.

2. The antenna as specified in claim 1 wherein the antenna has a Sector Power Ratio of less than 10%.

3. The antenna as specified in claim 2 wherein the antenna has a Sector Power Ratio of less than 5%.

4. The antenna as specified in claim 3 wherein the antenna has a Sector Power Ratio of less than 2%.

5. The antenna as specified in claim 1 comprising at least 2 of the directors.

6. The antenna as specified in claim 5 wherein said at least 2 of the directors are parallel to one another.

7. The antenna as specified in claim 5 wherein at least some of the directors are uniformly spaced from one another.

8. The antenna as specified in claim 7 wherein one of the directors is spaced closer to the radiating element than an adjacent said director.

9. The antenna as specified in claim 1 wherein the radiating element is a cross dipole radiating element.

10. The antenna as specified in claim 9 wherein the director has at least 2 members.

11. The antenna as specified in claim 10 wherein the members are cross-shaped members parallel to the cross dipole radiating element in the vertical direction.

12. The antenna as specified in claim 1 wherein the at least one director comprises a polygon shaped ring.

13. The antenna as specified in claim 12, further comprising a plurality of the polygon shaped rings disposed over the radiating element.

14. The antenna as specified in claim 13 wherein the polygon shaped rings are concentric.

15. The antenna as specified in claim 14 wherein the polygon shaped rings have a common diameter.

16. The antenna as specified in claim 14 wherein the polygon shaped rings have different diameters and form a tapered director.

17. The antenna as specified in claim 10 wherein the members have different lengths and form a tapered director.

18. The antenna as specified in claim 1 wherein the antenna has a front--to-side ratio of at least 20 dB.

19. The antenna as specified in claim 1 wherein the antenna has a front--to-back ratio of at least 40 dB.

20. An antenna, comprising:

a slant 45 degree dipole radiating element adapted to generate a beam; and director means disposed proximate the slant 45 degree dipole radiating element for directing the beam.

21. The antenna as specified in claim 20 wherein the director means establishes a Sector Power Ratio of the beam being less than 10%.

22. The antenna as specified in claim 20 wherein the director means establishes a Sector Power Ratio of the beam being less than 5%.

23. The antenna as specified in claim 20 wherein the director means establishes a Sector Power Ratio of the beam being less than 2%.

24. The antenna as specified in claim 20 wherein the director means establishes a front-to-back ratio of the beam of at least about 40 dB.

25. The antenna as specified in claim 20 wherein the director means establishes a front-to-side ratio of the beam of at least about 20 dB.

* * * * *